US006358070B1

(12) United States Patent
Lin

(10) Patent No.: US 6,358,070 B1
(45) Date of Patent: Mar. 19, 2002

(54) TRACK AND CONNECTOR ARRANGEMENT FOR A TRACK LIGHT

(76) Inventor: Shan Chaing Lin, No. 2, Lane 111, Ta Chu Road, Lu Chu Hsiang, Taoyuan Hsien (TW)

( * ) Notice: Subject to any disclaimer, the term of this patent is extended or adjusted under 35 U.S.C. 154(b) by 0 days.

(21) Appl. No.: 09/873,328

(22) Filed: Jun. 5, 2001

(51) Int. Cl.[7] ..... H01R 25/00
(52) U.S. Cl. ..... 439/115; 439/797
(58) Field of Search ..... 439/115, 210, 439/213, 723, 724, 727, 797

(56) References Cited

U.S. PATENT DOCUMENTS 2,997,688 A * 8/1961 Nielsen et al. ..... 439/797
3,622,938 A * 11/1971 Ito ..... 439/115
5,336,100 A * 8/1994 Gabrius et al. ..... 439/115
6,093,037 A * 7/2000 Lin ..... 439/115

* cited by examiner

*Primary Examiner*—Brian Sircus
*Assistant Examiner*—Son V. Nguyen
(74) *Attorney, Agent, or Firm*—Troxell Law Office PLLC

(57) ABSTRACT

A track and connector arrangement for a track light in which the connecting unit at each end of the connector has two conductor holders holding positive and negative conductors at a respective metallic spring plate, and the track has two electrically conductive wire rods of rectangular cross-section that are respectively inserted into the conductor holders and held in contact with the respective metallic spring plate in each conductor holder to receive power supply from the positive and negative conductors after connection of the connector to the track.

1 Claim, 6 Drawing Sheets

TRACK AND CONNECTOR ARRANGEMENT FOR A TRACK LIGHT

BACKGROUND OF THE INVENTION

The present invention relates to track lights and, more particularly, to a track and connector arrangement for a track light.

According to "connector for track" of U.S. Pat. No. 5,336,100, connector 2 has coupling means 22 for connection to track 1. Because the size of coupling means 22 is fixed, connector 2 is not extendable to fit different installation conditions. Further, when installed, there is an elevational difference between track 1 and connector 2, and the even outer appearance destroys the sense of beauty of the track light.

SUMMARY OF THE INVENTION

The present invention has been accomplished to provide a track and connector arrangement, which eliminates the aforesaid drawbacks. According to the present invention, the track and connector arrangement comprises at least one track, and a connector fastened to one end of each of the at least one track and adapted to connect power supply to light fixtures at each of the at least one track. The connector comprises a connecting unit at each end. The connecting unit comprises two conductor holders, the conductor holders each having a metallic spring plate on the inside, two conductors respectively mounted in the conductor holders and disposed in contact with the metallic spring plate in each conductor holder. Each track comprises two electrically conductive wire rods of rectangular cross-section that are respectively inserted into the conductor holders and held in contact with the respective metallic spring plate in each conductor holder to receive power supply from the conductors of the respective connecting unit after connection of the connector to the track.

DETAILED DESCRIPTION OF THE PREFERRED EMBODIMENT

Figure 1:
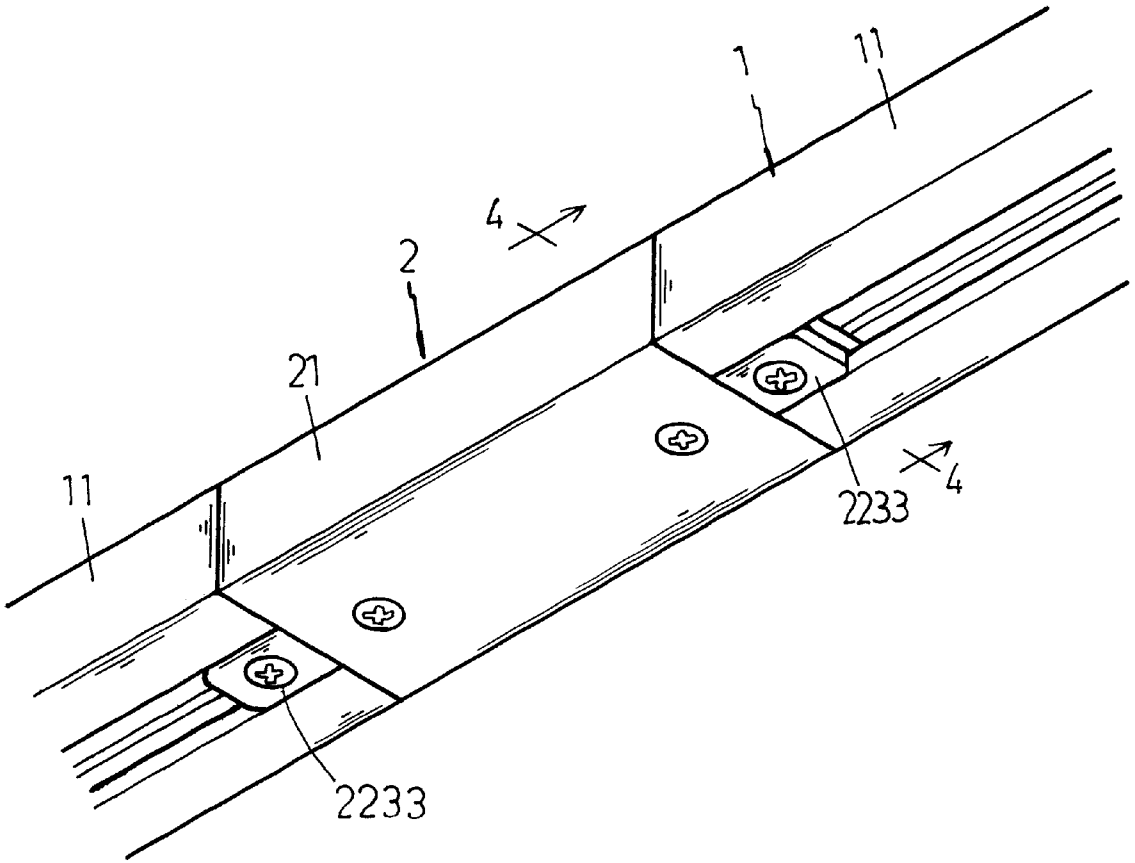
FIG. 1 is an elevational view of a track and connector arrangement according to a first embodiment of the present invention.
Figure 2:
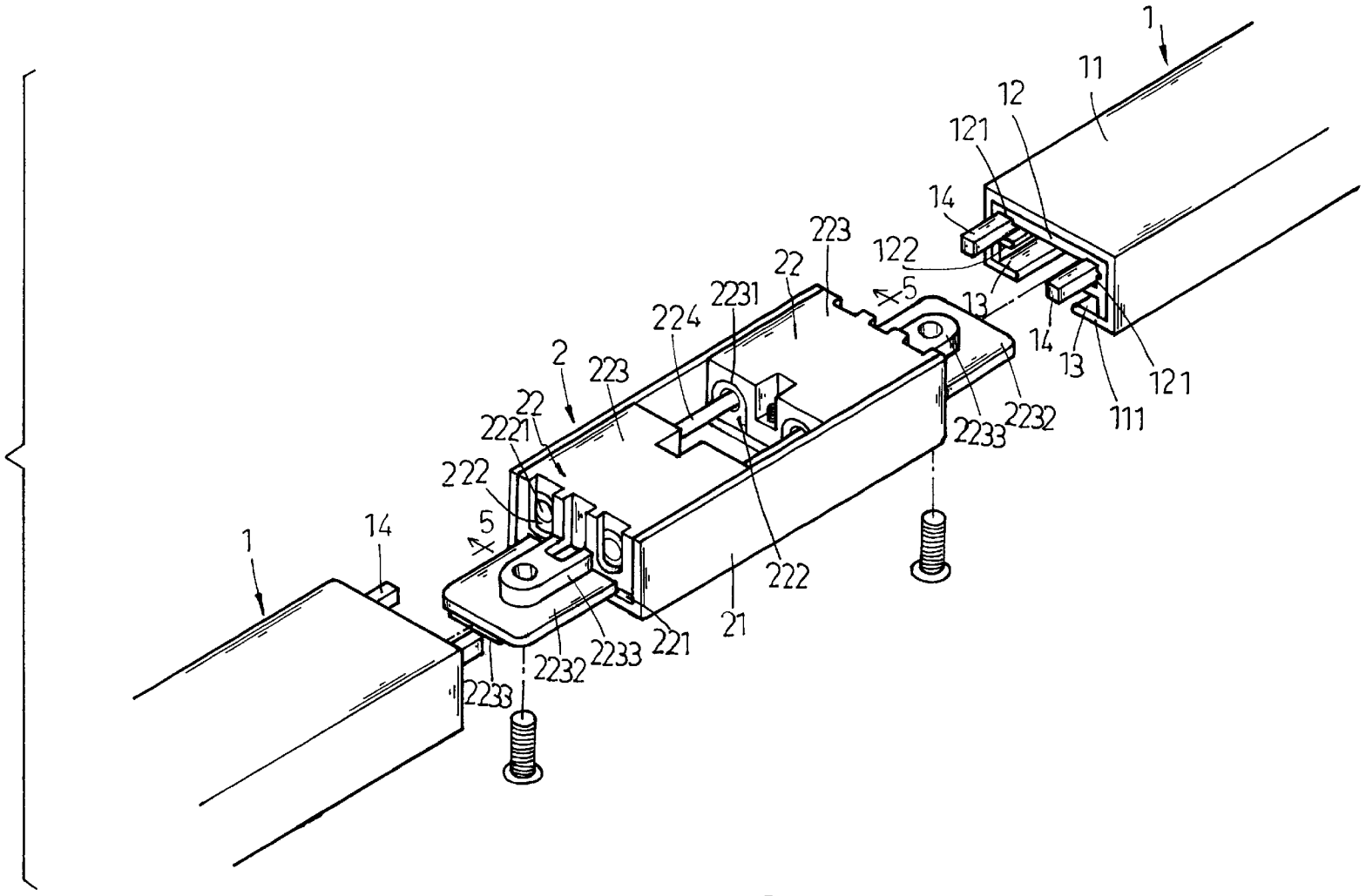
FIG. 2 is an exploded view of the first embodiment of the present invention.

Referring to FIGS. 1 and 2, a connector 2 is connected between two tracks 1 and adapted to transmit electricity from light fixtures at one track 1 to light fixtures at the other.

Figure 3:
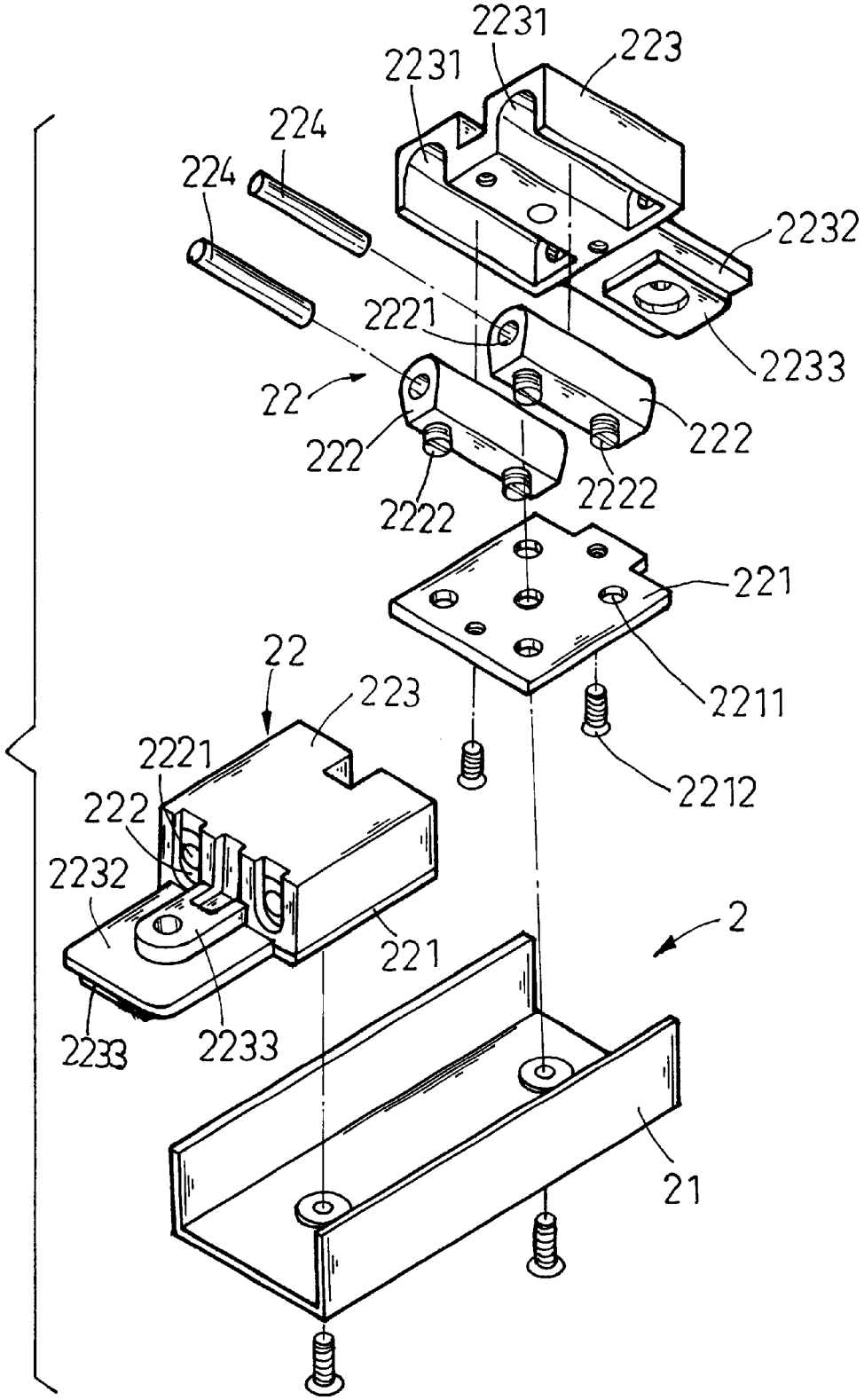
FIG. 3 is an exploded view of one connector of the first embodiment of the present invention.
Figure 4:
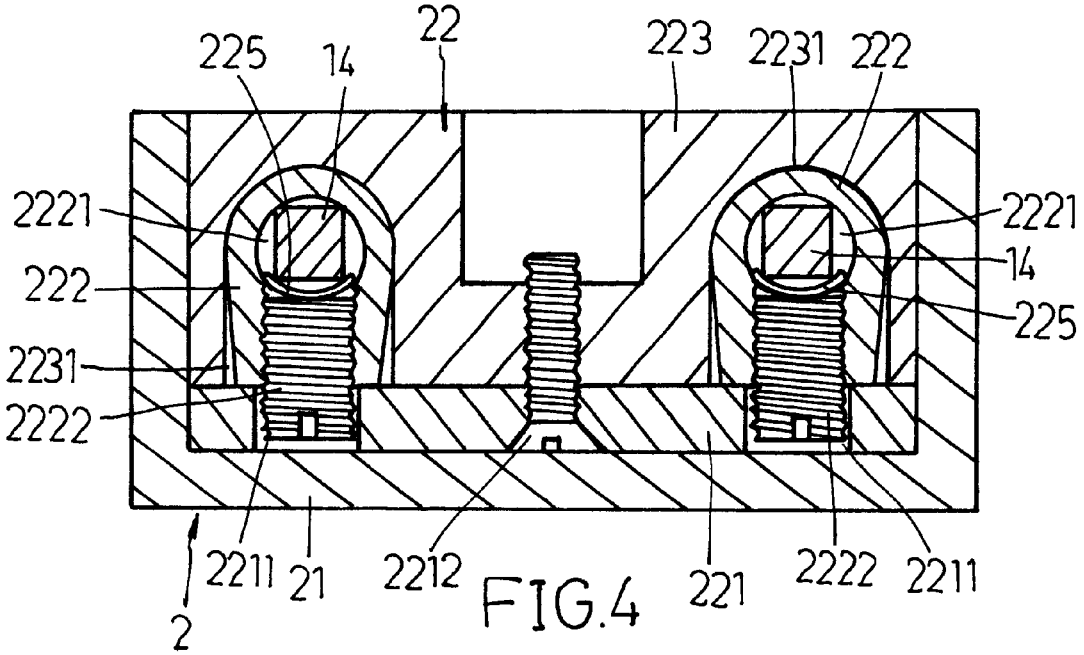
FIG. 4 is a sectional view in an enlarged scale taken along line 4—4 of FIG. 1.
Figure 5:
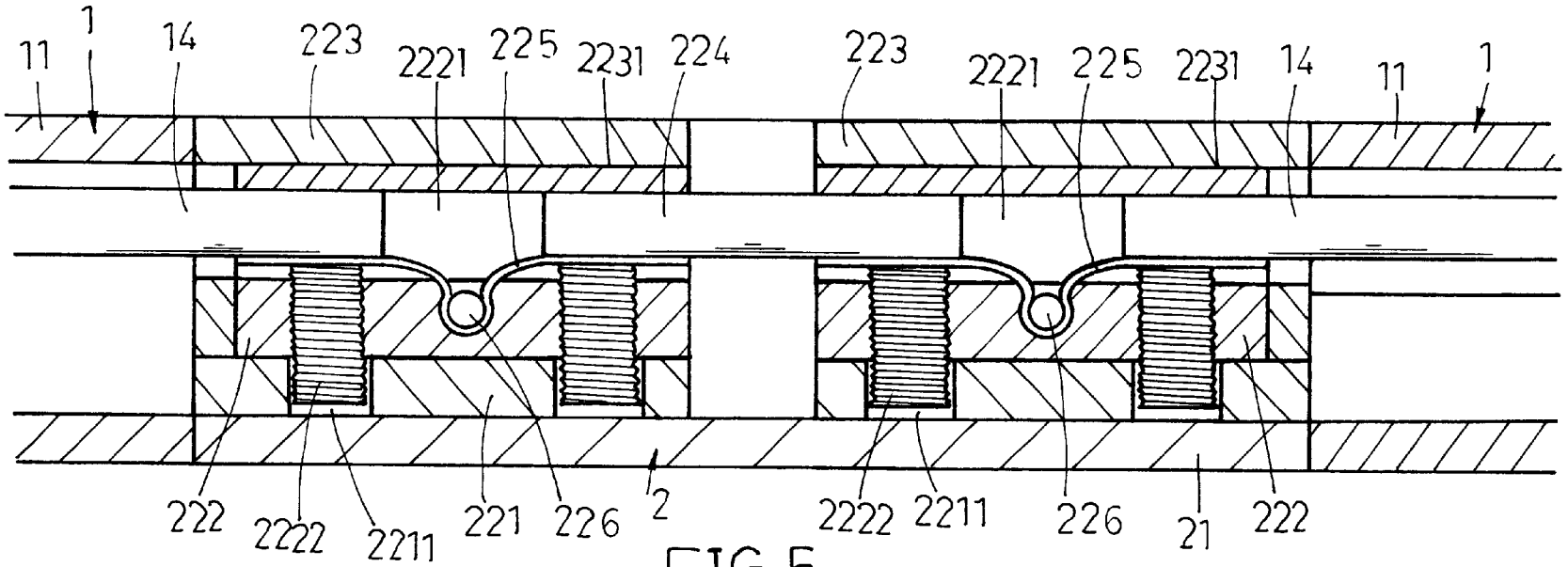
FIG. 5 is a sectional view in an enlarged scale taken along line 5—5 of FIG. 2.

Referring to FIGS. 2 and 3, the connector 1 is comprised of a metallic casing 11, an electrically insulative partition frame 12, and two electrically conductive wire rods 14 of rectangular cross-section. The metallic casing 11 is a hollow rectangular frame bar of substantially ⊓-shaped cross-section having two horizontally inwardly extended bottom flanges 111. The electrically insulative partition frame 12 is fixedly fastened to the inside wall of the casing 11, comprising two longitudinal grooves 121 arranged in parallel, and ribs 122, which define with the bottom flanges 111 a positioning chamber 13. The electrically conductive wire rods 14 are fastened to the longitudinal grooves 121 of the partition frame 12. The partition frame 12 keeps the electrically conductive wire rods 14 from touching the metallic casing 11.

Figure 6:
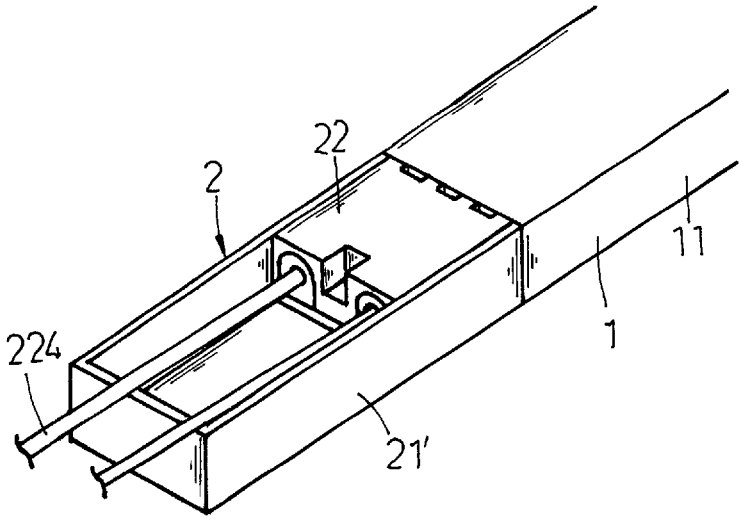
FIG. 6 is a perspective view of a track and connector arrangement according to a second embodiment of the present invention.

Referring to FIGS. from 2 through 6, the connector 2 is comprised of a holder frame 21, and at least one connecting unit 22. According to the embodiment shown in FIGS. from 2 through 5, the connector 2 is comprised of a holder frame 21 and two connecting units 22 for joining two tracks 1 and transmitting therebetween electricity. According to the embodiment shown in FIG. 6, the connector 2 comprises a holder frame 21' and one connecting unit 22 for connection to one end of a track 1 to transmit electricity by conductors 224 thereof to the electrically conductive wire rods of the track 1.

The connecting unit 22 is comprised of a mounting frame 221, two conductor holders 222, a cover plate 223, and two conductors 224. The mounting frame 221 is fixedly fastened to the holder frame 21 or 21' by screws, comprising two pairs of locating holes 2211. The cover plate 223 is fixedly fastened to the mounting frame 221 by screws 2212, comprising two parallel receiving chambers 2231, which receive the conductor holders 222 respectively, an extension plate 2232 axially extended from one end thereof, and a locating block 2233 fixedly provided at a bottom side of the extension plate 2232. The conductor holders 222 are respectively mounted in the receiving chambers 2231 of the cover plate 223, each having an axially extended through hole 2221, which receives one conductor 224, two bolts 2222 respectively fastened to the mounting holes 2211 of the mounting frame 221, a locating rod 226 disposed on the inside, and a spring plate 225 coupled to the locating rod 226 and supported between the bolts 2222 and one conductor 224.

Referring to FIGS. 1 and 3, the extension plate 2232 of the cover plate 223 of one connecting unit 22 is plugged into the positioning chamber 13 of one track 1, and then the locating block 2233 of the extension plate 2232 is fixedly fastened to the track 1 by screws. When installed, the electrically conductive wire rods 14 of the track 1 are respectively inserted into the axially extended through hole 2221 of each of the conductor holders 222 of the corresponding connecting unit 22 and fastened to the spring plate 225 in each of the conductor holders 222.

Figure 7:
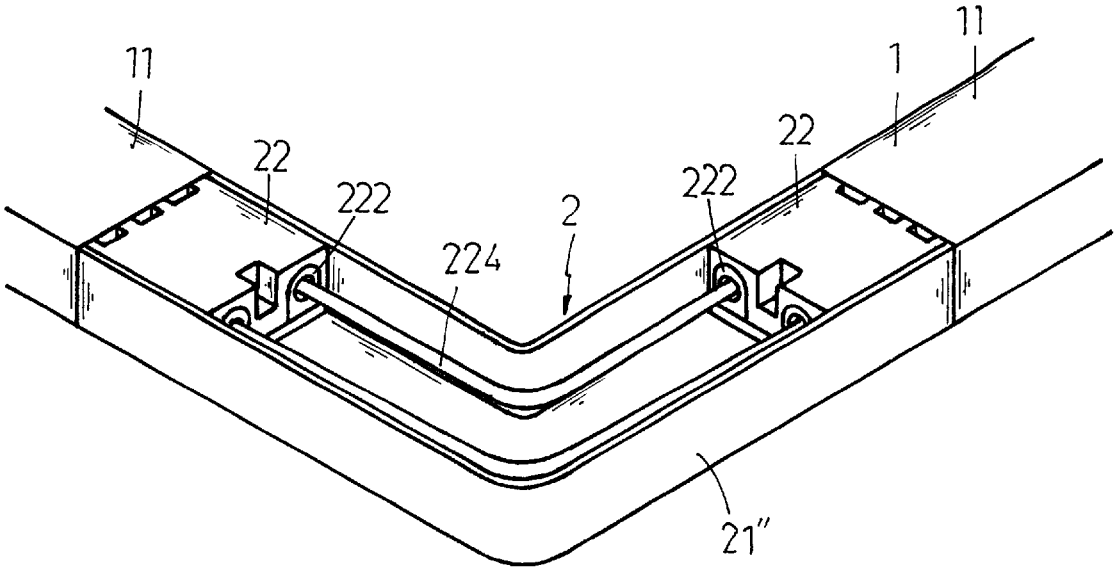
FIG. 7 is a perspective view of a track and connector arrangement according to a third embodiment of the present invention.

The length and shape of the connector 2 can be made to fit actual installation requirement. In FIG. 7, the holder frame 21" of the connector 2 has a L-shaped profile holding two connecting units 22 at right angles.

A prototype of track and connector arrangement has been constructed with the features of FIGS. 1~7. The track and connector arrangement functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A track and connector arrangement comprising at least one track, and a connector fastened to one end of each of said at least one track and adapted to connect power supply to light fixtures at said at least one track, wherein said at least one track each comprises a metallic casing, an electrically insulative partition frame fixedly mounted inside said casing, said electrically insulative partition frame comprising two longitudinal grooves arranged in parallel, and two electrically conductive wire rods respectively mounted in said longitudinal grooves of said partition frame and separated from said metallic casing by said electrically insulative partition frame, said electrically conductive wire rods having a rectangular cross-section; said connector comprises a holder frame and at least one connecting unit fixedly mounted in said holder frame and respectively connected to said at least one track, said at least one connecting unit each comprising a mounting frame fixedly fastened to one end of said holder frame, two conductor holders respectively mounted on said mounting frame and arranged in parallel, said conductor holders each comprising an axially extended through hole, a locating rod, and a metallic spring plate coupled to said locating rod and held inside said axially extended through hole, two conductors respectively mounted in the axially extended through hole of each of said conductor holders and disposed in contact with the metallic spring plate of each of said conductor holders, a cover plate fixedly fastened to said mounting frame and covered on said mounting frame, said cover plate comprising an extension plate axially extended from one end thereof and fastened to one of said at least one track for enabling the electrically conductive wire rods of the corresponding track to be respectively inserted into the axially extended through hole of each of said conductor holders to touch said metallic spring plate and to receive power supply from said conductors.

* * * * *